US005762536A

United States Patent [19]

Pant et al.

[11] Patent Number: 5,762,536

[45] Date of Patent: Jun. 9, 1998

[54] SENSORS FOR A LINEAR POLISHER

[75] Inventors: Anil K. Pant, Santa Cruz, Calif.; Joseph R. Breivogel, Aloha, Oreg.; Douglas W. Young, Sunnyvale, Calif.; Rahul Jairath, San Jose, Calif.; Erik H. Engdahl, Livermore, Calif.

[73] Assignee: Lam Research Corporation, Fremont, Calif.

[21] Appl. No.: 797,470

[22] Filed: Feb. 6, 1997

Related U.S. Application Data

[63] Continuation-in-part of Ser. No. 638,462, Apr. 26, 1996.

[51] Int. Cl.[6] ..... B24B 49/00; B24B 51/00

[52] U.S. Cl. ..... 451/6; 451/276; 451/303

[58] Field of Search ..... 451/296, 307, 451/5, 6, 8, 9, 10, 11, 303, 285, 287, 288, 41, 28

[56] References Cited

U.S. PATENT DOCUMENTS

| | | | |
|---|---|---|---|
| 1,493,779 | 5/1924 | Humphreys | 451/303 |
| 3,363,366 | 1/1968 | Estabrook | 451/296 |
| 3,727,350 | 4/1973 | Schaller | 451/303 |
| 3,801,239 | 4/1974 | Kiser | 451/303 |
| 4,793,895 | 12/1988 | Kaanta et al. | 156/627 |
| 5,036,015 | 7/1991 | Sandhu et al. | 437/8 |
| 5,081,421 | 1/1992 | Miller et al. | 324/671 |
| 5,081,796 | 1/1992 | Schultz | 51/165.74 |
| 5,213,655 | 5/1993 | Leach et al. | 156/627 |
| 5,240,552 | 8/1993 | Yu et al. | 156/636 |
| 5,308,438 | 5/1994 | Cote et al. | 156/636 |
| 5,321,304 | 6/1994 | Rostoker | 257/621 |
| 5,431,592 | 7/1995 | Nakata | 451/296 |
| 5,433,651 | 7/1995 | Lustig et al. | 451/6 |
| 5,558,568 | 9/1996 | Talieh et al. | 451/303 |
| 5,569,063 | 10/1996 | Morioka et al. | 451/296 |
| 5,593,344 | 1/1997 | Weldon et al. | 451/296 |

FOREIGN PATENT DOCUMENTS

| | | | |
|---|---|---|---|
| 0738561 A1 | 10/1996 | European Pat. Off. | B24B 37/04 |

*Primary Examiner*—Timothy V. Eley
*Assistant Examiner*—Derris H. Banks
*Attorney, Agent, or Firm*—Kidd & Booth, LLP

[57] ABSTRACT

A technique for utilizing sensors to monitor the polishing of a semiconductor wafer when a linear polisher is utilized to polish the wafer. The sensors are distributed along the surface or are coupled to openings along the surface to monitor the on-going polishing process. The sensed information from the sensors are processed in order to provide feedback for compensating the fluid dispensing when fluid platens are used and/or the downforce exerted by the wafer carrier.

20 Claims, 3 Drawing Sheets

SENSORS FOR A LINEAR POLISHER

This is a continuation-in-part (C.I.P.) application of Ser. No. 08/638,462, filed on Apr. 26, 1996 and titled "Control Of Chemical-Mechanical Polishing Rate Across A Substrate Surface For A Linear Polisher," which application is incorporated by reference herein.

BACKGROUND OF THE INVENTION

1. Field of the Invention

The present invention relates to the field of semiconductor wafer processing and, more particularly, to the polishing of semiconductor wafers utilizing a linear polisher.

2. Related Applications

This is a continuation-in-part (C.I.P.) application of Ser. No. 08/638,462, filed Apr. 26, 1996 and titled "Control Of Chemical-Mechanical Polishing Rate Across A Substrate Surface For A Linear Polisher," which application is incorporated by reference herein and is also related to a patent application titled "Control Of Chemical-Mechanical Polishing Rate Across A Substrate Surface;" Ser. No. 08/638,464; filed Apr. 26, 1996.

3. Background of the Related Art

The manufacture of an integrated circuit device requires the formation of various layers (both conductive and non-conductive) above a base substrate to form the necessary components and interconnects. During the manufacturing process, removal of a certain layer or portions of a layer must be achieved in order to pattern and form various components and interconnects. Chemical mechanical polishing (CMP) is being extensively pursued to planarize a surface of a semiconductor wafer, such as a silicon wafer, at various stages of integrated circuit processing. It is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer in combination with the chemical reaction of the slurry disposed between the wafer and the pad, provide the abrasive force with chemical erosion to polish the exposed surface of the wafer (or a layer formed on the wafer), when subjected to a force pressing the wafer onto the pad. In the most common method of performing CMP, a substrate is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head. Rotation of the polishing head helps in the slurry delivery as well in averaging the polishing rates across the substrate surface.

Another technique for performing CMP to obtain a more uniform polishing rate is to utilize a linear polisher. Instead of a rotating pad, a moving belt is used to linearly move the pad across the wafer surface. The wafer is still rotated for averaging out the local variations, but the global planarity is improved over CMP tools using rotating pads. One such example of a linear polisher is described in the aforementioned parent application.

Unlike the hardened table top of a rotating polisher, linear polishers are capable of using flexible belts, upon which the pad is disposed. This flexibility allows the belt to flex, which can cause a change in the pad pressure being exerted on the wafer. When this flexibility can be controlled, it provides a mechanism for controlling the polishing rate and/or the profile. Thus, a fluid platen can be readily utilized to control the pad pressure being exerted on a wafer at various locations along the wafer surface. Examples of fluid platens are disclosed in the afore-mentioned related applications and in U.S. Pat. No. 5,558,568.

Whether fluid platens are utilized or not utilized, it is desirable to control or at least monitor the polishing process during the actual polishing process. Prior art techniques typically rely on past performance to estimate the current process, rely on some form of end-point detection for terminating the polishing process or the process is stopped intermittently to evaluate the process. It would be advantageous to provide some form of monitoring during the actual polishing process so that an in-situ measurement can be obtained while the polishing is on-going. It would also be advantageous to utilize such measurements to provide in-situ adjustments during the polishing process. The present invention provides for such a monitoring scheme.

SUMMARY OF THE INVENTION

The present invention describes a technique for utilizing sensors to monitor a polishing characteristic of a substrate, such as a wafer, during polishing. In the specific embodiment, a linear polisher, which employs a fluid platen, is utilized to perform chemical-mechanical polishing on a semiconductor wafer. The sensors are distributed along the surface or are coupled to openings along the surface to determine a polishing characteristic of the polishing pad relative to the wafer surface.

In one embodiment, proximity sensors are used at or coupled to various sensing locations along the surface of the platen to measure the proximity of the overlying belt/pad assembly with respect to the platen. The sensed proximity values provide information as to the gap separating the belt/pad from the platen when a fluid platen is used. In another embodiment, sensors are used to sense the actual force being exerted at the corresponding locations. When a fluid platen is employed, a pressure sensor is used to measure the pressure of a fluid distributed along the surface of a fluid platen.

The measured values from the sensors are utilized to provide useful polishing information during use, as well as providing constant feedback to provide in-situ adjustments of the polishing process. The adjustments can be in the manner of controlling the localized areas associated with a given sensor or providing an averaging value for the overall cross-section of the surface.

DETAILED DESCRIPTION OF THE PREFERRED EMBODIMENTS

A scheme for monitoring (or sensing) a polishing characteristics of a polishing pad relative to a wafer for polishing the wafer surface is described. In the following description, numerous specific details are set forth, such as specific structures, sensors, sensing techniques, etc., in order to provide a thorough understanding of the present invention. However, it will be appreciated by one skilled in the art that the present invention may be practiced without these specific details. In other instances, well known techniques and structures have not been described in detail in order not to obscure the present invention. It is to be noted that the present invention is described herein in reference to a linear polisher, however, it is readily understood that the present invention can be practiced with other types of polishers without departing from the spirit and scope of the present invention. Furthermore, although the present invention is described in reference to performing CMP on a semiconductor wafer (more so to a silicon semiconductor wafer), the invention can be readily adapted to polish other materials as well, such as glass, metal substrates or other semiconductor substrates, including substrates for use in manufacturing flat panel displays.

Figure 1:
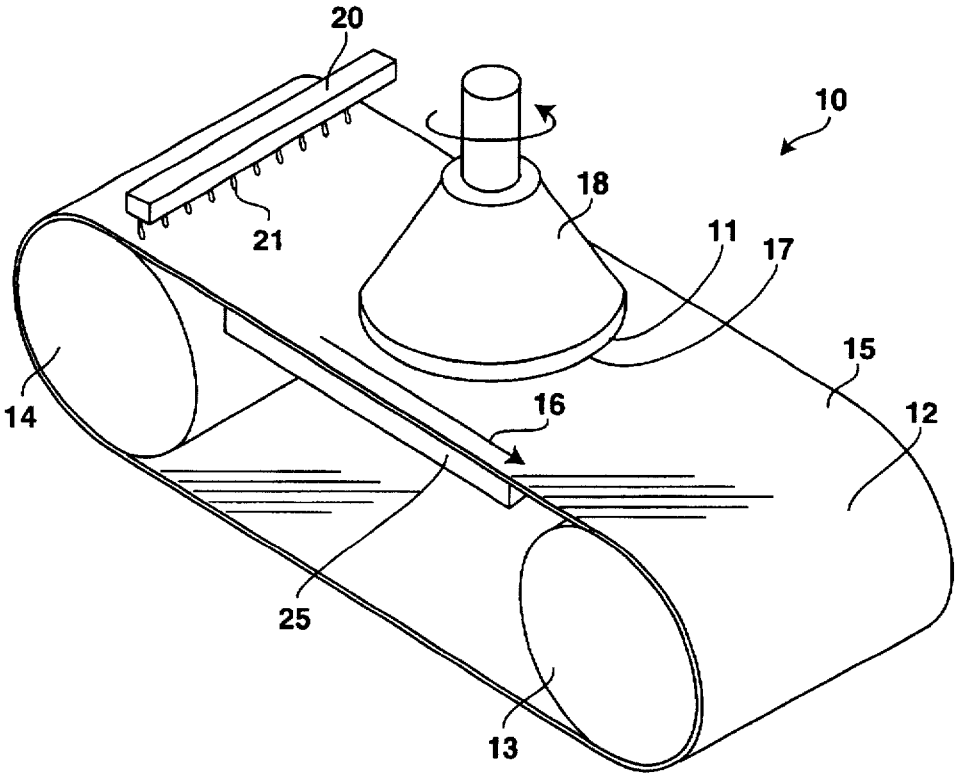
FIG. 1 is a pictorial illustration of a linear polisher for practicing the present invention.
Figure 2:
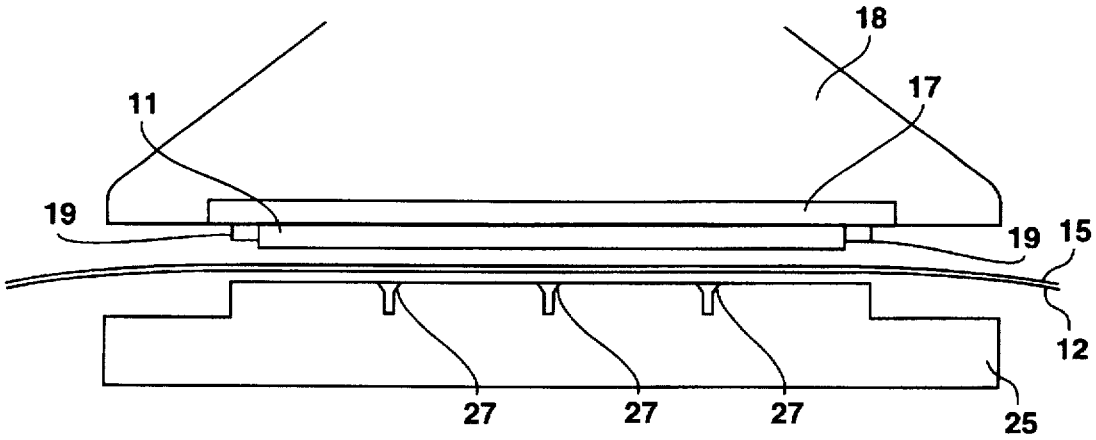
FIG. 2 is a cross-sectional diagram of a portion of the linear polisher of FIG. 1 and showing the inclusion of a number of sensor input locations for sensors of the present invention in a wafer support platen disposed underlying a belt/pad assembly.

Referring to FIG. 1, a linear polisher 10 for use in practicing the present invention is shown. FIG. 2 shows a cross-section of a portion of the polisher 10. The linear polisher 10 is utilized in polishing a semiconductor wafer 11, such as a silicon wafer, to polish away materials on the surface of the wafer. The material being removed can be the substrate material of the wafer itself or one of the layers formed on the substrate. Such formed layers include dielectric materials (such as silicon dioxide), metals (such as aluminum, copper or tungsten) and alloys, or semiconductor materials (such as silicon or polysilicon). More specifically, a polishing technique generally known in the art as chemical-mechanical polishing (CMP) is employed to polish one or more of these layers fabricated on the wafer 11, in order to planarize the surface. Generally, the art of performing CMP to polish away layers on a wafer is known and prevalent practice has been to perform CMP by subjecting the surface of the wafer to a rotating platform (or platen) containing a pad (see for example, the Background section above).

The linear polisher 10 utilizes a belt 12, which moves linearly in respect to the surface of the wafer 11. The belt 12 is a continuous belt rotating about rollers (or spindles) 13 and 14, in which one roller or both is/are driven by a driving means, such as a motor, so that the rotational motion of the rollers 13–14 causes the belt 12 to be driven in a linear motion (as shown by arrow 16) with respect to the wafer 11. A polishing pad 15 is affixed onto the belt 12 at its outer surface facing the wafer 11. Thus, the belt/pad assembly is made to move linearly to polish the wafer 11.

The wafer 11 typically resides within a wafer carrier 17, which is part of a housing 18. The wafer 11 is held in position by a mechanical retaining means, such as a retainer ring 19, and/or by the use of vacuum. Generally, the wafer 11 is rotated, while the belt/pad moves in a linear direction 16 to polish the wafer 11. The linear polisher 10 also includes a slurry dispensing mechanism 20, which dispenses a slurry 21 onto the pad 15. A pad conditioner (not shown in the drawings) is typically used in order to recondition the pad 15 during use. Techniques for reconditioning the pad 15 during use are known in the art and generally require a constant scratching of the pad in order to remove the residue build-up caused by the used slurry and removed waste material.

A platen 25 is disposed on the underside of belt 12 and opposite from carrier 17, such that the belt/pad assembly resides between platen 25 and wafer 11 (which illustration is more clearly shown in FIG. 2). A primary purpose of platen 25 is to provide a supporting platform on the underside of the belt 12 to ensure that the pad 15 makes sufficient contact with wafer 11 for uniform polishing. Typically, the carrier 17 is pressed downward against the belt 12 and pad 15 with appropriate force, so that the pad 15 makes sufficient contact with the wafer 11 for performing CMP. Since the belt 12 is flexible and will depress when the wafer is pressed downward onto the pad 15, platen 25 provides a necessary counteracting support to this downward force (also referred to as downforce).

Platen 25 can be a solid platform or it can be a fluid platen (also referred to as a fluid bearing). The preference is to have a fluid platen, so that the fluid flow from the platen can be used to control forces exerted to the underside of the belt 12. By such fluid flow control, pressure variations exerted by the pad on the wafer can be adjusted to provide a more uniform polishing rate of the wafer. Examples of fluid platens are disclosed in the afore-mentioned parent related applications and in U.S. Pat. No. 5,558,568.

Whether a solid platen or a fluid platen is used, it is desirable to monitor the on-going process to determine the polishing performance of a linear polisher. However, the monitoring of the polishing performance for a linear polisher using a fluid platen is more advantageous, since the monitoring data can be used to adjust the fluid pressure at varying locations of the platen to provide in-situ corrections during the polishing process. The present invention describes a scheme of providing sensors to monitor the polishing process.

In order to obtain monitoring of the polishing process, the platen 25 incorporates a number of sensors. The sensors can be located at the sensing points along the surface of the platen or they can be located elsewhere (even away from the platen itself), in which instance such sensors are coupled to sensing input locations along the surface of the platen. Thus, in FIG. 2, the sensing locations 27 are shown disposed along the surface of the platen 25 to monitor a parameter of the polishing medium relative to the surface of the wafer 11. The polishing medium in this instance includes the belt/pad assembly and the slurry, which is made to flow over the pad surface. As will be noted below, the sensors employed can measure a variety of parameters which can provide information related to the polishing profile of the wafer surface. In one embodiment noted below, sensors are utilized to measure the proximity of the underside of the belt 12 relative to the platen 25. In another embodiment, sensors are used to measure the pressure exerted onto the fluid flowing between the platen and the underside of the belt 12, when a fluid platen is utilized.

Figure 3:
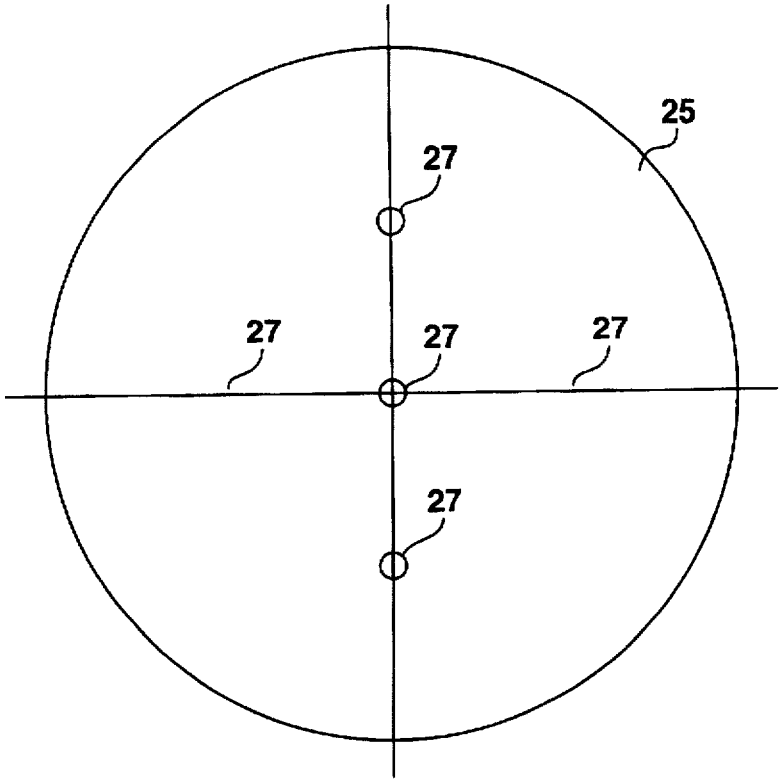
FIG. 3 is a top plan view of the wafer support platen of FIG. 2, in which the sensing locations are shown distributed at various locations across the surface of the platen.

Referring to FIG. 3, an example for platen 25 is shown in which five sensor input locations 27 are disposed along the surface. One sensor input location 27 is disposed at the center and one each spaced 90 degrees apart along a concentric circle of a predetermined radius. The five sensor inputs essentially measure the center location and four quadrant locations of the platen surface. It is appreciated that the number and/or the location of the sensing locations is a design choice. Five sensing locations 27 are utilized in the example, since a representative sampling can be obtained across the surface of the platen 25. As will be noted below, the five sensed values will be used also to obtain an average value across the wafer surface.

In the practice of the present invention, the sensing inputs are utilized to measure and determine the gap separation between the belt and the platen and/or the pressure exerted by the pad/belt onto the platen. It is appreciated that the region underlying the pad (or the belt upon which the pad is mounted) will vary in the separation distance with respect to the platen and will also vary in the pressure exerted by the belt/pad due to a number of factors. These factors include, but are not limited to, wafer curvature, variations of the wafer topology, non-uniform planarity of the belt/pad, flexibility of the belt, non-uniform slurry distribution, unequal force exerted by the wafer carrier when pressing the wafer onto the pad and unequal force due to gimbaling of the wafer. When fluid platens are utilized, fluid dispensing into this region is also a factor. Thus, for a variety of reasons, the polishing profile of the wafer surface may not be uniform or may not fit a desired polishing profile for a given polishing process.

A way of making adjustments to bring the process under tolerance during the actual polishing process is to monitor the gap separation between the platen and the belt and/or the pressure being exerted on the platen (or the fluid when fluid platens are used). The monitoring can be done at various locations along the platen surface during the polishing process, as exemplified by sensing locations 27 in FIG. 3. Thus, the sensors of the present invention will provide in-situ monitoring during the polishing process. Although a variety of sensors can be used to monitor the gap or the pressure, the two preferred techniques are described herein.

Figure 4:
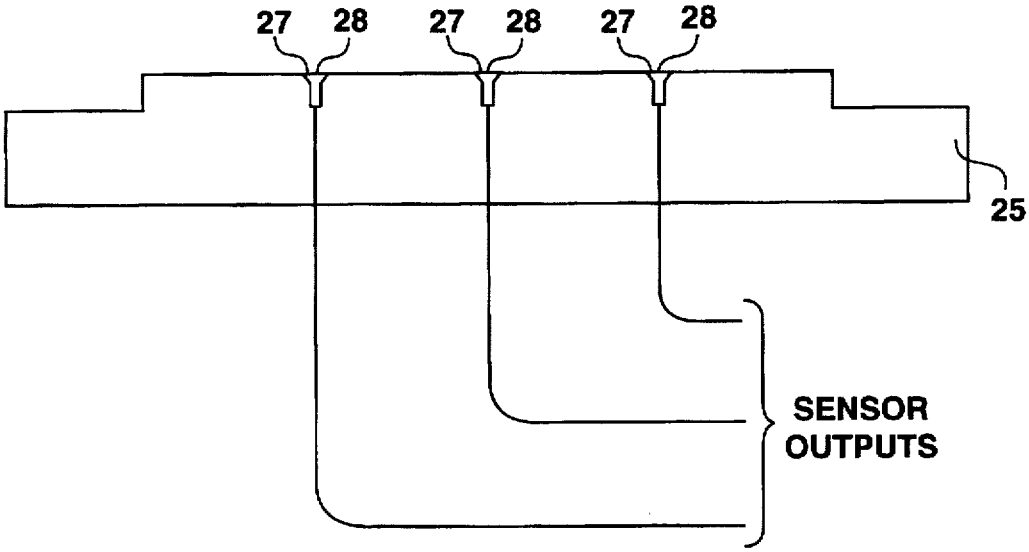
FIG. 4 is a cross-sectional diagram of the wafer support platen when proximity sensors are employed within the platen to measure the separation between the platen surface and the belt/pad assembly.

Referring to FIG. 4, the platen 25 incorporates proximity sensors 28 to measure the separation between each sensor 28 and the underside of the belt 12 at each sensing location 27. The proximity sensors 28, as shown, are disposed within openings (or cavities) formed within platen 25 along the platen surface so that the sensor is substantially flush with the platen surface. Each proximity sensor 28 measures the gap separating the sensor and the belt. An example of such a gap sensor is a Linear Proximity Sensor, Model Type E2CA, manufactured by Omron Corporation.

It is appreciated that the type of proximity sensor used is a design choice. Thus, inductive sensors can be used when stainless steel (or other metallic material) is used for the belt 12. Optical sensors can be used for both metallic and non-metallic belts. Furthermore, in some instances (such as when certain optical sensors are utilized), it may not be necessary to actually locate the sensor along the surface of the platen 25. In such an instance, an optical channel will couple the sensors to the sensing input locations 27 along the surface.

Each proximity sensor 28 measures the gap separation between it and the underside of the belt/pad assembly. Through experimentation, ideal gap distances at various sensor locations are determined for each type of linear polisher system to achieve a uniform rate of polish across the wafer surface. Once these values are determined for a system, the sensors can be used to adjust various parameters to obtain or assist in obtaining the desired polishing profile.

When a fluid platen is utilized for platen 25, there will be fluid flow between the platen surface and the underside of the belt 12. The fluid platens described in the aforementioned references provide for multiple fluid dispensing channels where these channels are grouped and coupled to independent dispensing controls. Although not shown in FIGS. 4 and 5, it is to be noted that individual fluid flow (or fluid dispensing pressure) control can be provided for adjusting the fluid being dispensed onto the surface of the platen and this can be done for each of the independently controlled regions on the platen surface.

By placing sensing locations 27 on the platen to correspond with the fluid dispensing scheme, each sensing location 27 can be associated to a corresponding fluid dispenser or dispensers. It is appreciated that each sensing location can be associated with one or more fluid dispensing channels, so that monitored data can be used as feedback to control the appropriate dispenser(s). It is also appreciated that the present invention can be made to operate where there may not be one-to-one correspondence with a corresponding fluid dispenser. When gap sensing is being performed, the information corresponds to the thickness of the fluid residing between the platen 25 and the belt 12 at the particular sensor location 27. That is, the fluid thickness is equivalent to the gap distance. Typically, the fluid thickness is in the range of 2–7 mils, however, the actual thickness can vary outside of this range. When the gap separation is zero, the belt is making contact with the platen surface, indicating that there is no longer a fluid presence at that sensed location.

The gap separation information can be used to identify locations where the fluid thickness locations are out of tolerance. Accordingly, gap information can be used to identify wear on the system (such as the belt), gimbaling or improper gimbaling of the wafer, or improper positioning of the wafer carrier. Thus, when a particular sensor for a fluid platen senses a gap distance which is out of tolerance, the corresponding fluid dispenser associated with the area of the surface being monitored by that sensor can be adjusted in order to bring the gap distance back into tolerance.

Alternatively, since the wafer is being rotated, the sensor inputs can be combined to provide an average value of the gap. For example, in the five sensor arrangement shown in the Figures, the five sensed readings are averaged to obtain an average gap distance. This average value identifies an average fluid thickness on the surface of the platen. When the average value is out of tolerance, the fluid dispensers can be adjusted to increase or decrease the average thickness of the fluid.

Furthermore, since the gap separation is a function of both the fluid flow and the downforce of the wafer onto the platen, the average value can be used to adjust the average downforce as well. However, the preference is to adjust the fluid flow onto the fluid platen. Thus, in-situ adjustments can be made during operation of the linear polisher by adjusting the fluid flow onto the fluid platen and/or, in some instance, the downforce exerted by the wafer carrier.

Figure 5:
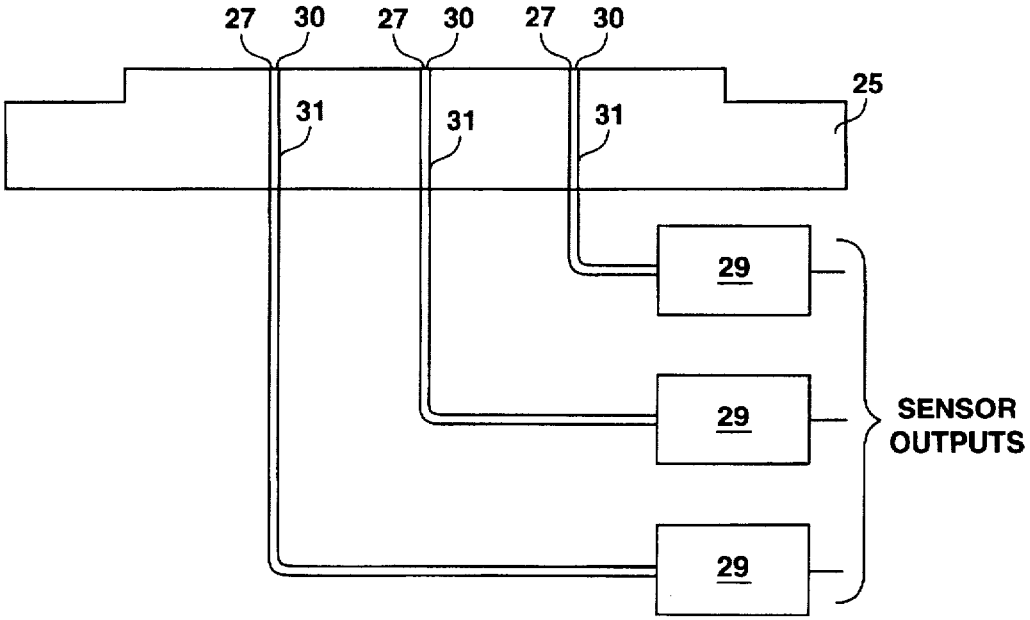
FIG. 5 is a cross-sectional diagram of the wafer support platen when the platen is used as a fluid platen, in which channels are disposed within the platen to couple dispensed fluid to sensors to measure fluid pressure at corresponding sensing locations.

Another equivalent monitoring scheme is shown in an alternative embodiment of FIG. 5. Again, fluid dispensing openings and channels are not shown, but it is appreciated that such fluid dispensing schemes are present when fluid platens are utilized. In FIG. 5, sensors are shown not mounted directly in the platen itself at sensing locations 27 (although they could be). Instead, sense openings 30 are formed on the surface of the platen 25. Each of the openings actually forms a channel 31 through the platen 25, which openings 30 can have a pattern equivalent to the sensing locations earlier described. The other end of each channel 31 is coupled to a pressure sensor 29, which in this instance is a pressure indicator. During operation, the fluid flow onto a fluid platen disperses along the surface of the platen 25. Since the belt 12 is within close proximity of the platen surface, the area between the platen 25 and the underside of the belt 12 is also filled with the fluid. The fluid will also flow into openings 30 and fill channels 31 (and any associated coupling lines to sensor 29).

The variations in the force exerted at a particular location during polishing will cause an increase (or decrease) in the pressure being exerted onto the fluid at that location. The increase (or decrease) in the fluid pressure will also occur to the fluid in the channel 31 for the opening 30 in close proximity. The fluid pressure variation is sensed and measured by the corresponding pressure sensor 29. Thus, sensors 29 detect fluid pressure variations of fluid platens corresponding to its sensing location 27.

Accordingly, the outputs from the sensors 29 are used to adjust corresponding fluid dispensing controls of a fluid platen. Individual adjustments can be made for each sensor 29 when a particular sensor senses an out-of-tolerance condition. Furthermore, the sensor outputs can be combined to provide an average value, as was noted earlier with the gap sensors. Since the pressure is more directly associated with the downforce being exerted by the wafer onto the pad, the average pressure value provides information about the average downforce being exerted by the wafer carrier. When the average pressure value is out of tolerance, the fluid flow can be adjusted to compensate. Alternatively (or in conjunction) the downforce of the wafer carrier can be adjusted to bring the average value back into tolerance. Thus, the pressure sensors allow for a means of adjusting the wafer downforce.

Figure 6:
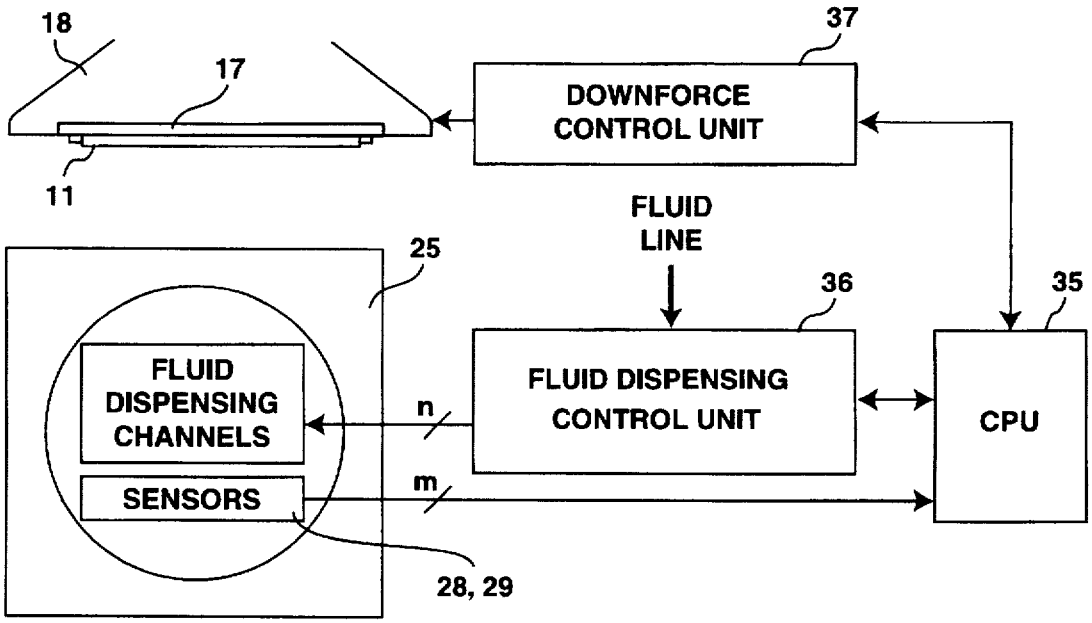
FIG. 6 is a block schematic diagram of a polishing tool incorporating the sensors in a fluid platen and in which automated feedback adjustment control is utilized in response to sensor measurements to compensate for variations in the polishing performance.

As shown in FIG. 6, the outputs from the sensors (either or both types of sensors) can be coupled to a processor, which is shown as a central processing unit (CPU) 35. The CPU 35 processes the sensor inputs and generates signals to a fluid dispensing control unit 36, which adjusts the appropriate fluid dispenser(s). As noted, the various techniques for providing fluid platens with separate flow adjustment control are described in the afore-mentioned references, including the parent application. Whenever the sensed system parameters are out of tolerance, the CPU 35 receives the sensed information from the sensors and issues commands to the fluid dispensing control unit 36 to adjust the fluid pressure(s) to compensate the individual fluid dispensers or, if the averaging technique is used, to obtain the desired average profile. Likewise, the CPU 35 can be used to send a control signal to a wafer downforce control unit 37 to adjust the downforce being exerted by the carrier 17 in pressing the wafer 11 down onto the pad 15.

Thus, a scheme for monitoring the polishing characteristics of a polishing pad relative to a wafer is described. It is appreciated that the sensors of the present invention are described in reference to a linear polisher, however, the sensors can be adapted for use on other tools, including the rotating polishers well know in the art for performing CMP. Furthermore, the sensing schemes of the present invention can be used with non-fluid platens as well. For example, when non-fluid (or standard) platens are used, the gap separation between the platen and the belt is generally zero. The belt essentially rides on the platen. In this instance, strain gauges can be disposed at the various locations 27 so that each of the gauges will sense the pressure being exerted by the belt onto the platen. The measured values can be averaged to provide the downforce adjustment as noted earlier.

Accordingly, with the sensors of the present invention, the measured values from the sensors are utilized to provide useful polishing information during polishing, as well as providing constant feedback to provide in-situ adjustment of the polishing process. The adjustments can be in the manner of adjusting the localized areas associated with a given sensor or providing an averaging value for the overall cross-section of the surface. The two techniques described herein utilize proximity sensing and pressure sensing, but it is appreciated that other sensing techniques can be readily used without departing from the spirit and scope of the present invention.

We claim:

1. In a tool utilized to polish a material having a planar surface and in which said planar surface is placed upon a polishing pad for polishing said planar surface, an apparatus for determining a polishing force exerted onto said planar surface comprising:

a platen disposed along an underside of said pad opposite said surface;

a sensor coupled to said platen to measure a gap distance between said platen and said pad to determine said polishing force.

2. The apparatus of claim 1 wherein said sensor is a proximity sensor.

3. In a tool utilized to polish a material having a planar surface and in which said planar surface is placed upon a polishing pad for polishing said planar surface, an apparatus for determining a polishing force exerted onto said planar surface comprising:

a platen disposed along an underside of said pad opposite said surface;

a pressure sensor coupled to said platen to measure pressure being exerted on said platen to determine said polishing force.

4. In a linear polisher for performing chemical-mechanical polishing (CMP) on a surface of a substrate or a layer formed on said substrate, and in which said surface is placed upon a linearly moving polishing pad for polishing said surface, an apparatus for determining a separation distance of a region underlying said pad comprising:

a platen disposed along an underside of said pad opposite said surface;

plurality of sensors coupled to said platen to measure said separation distance between said platen and said pad or a belt upon which said pad is mounted at a plurality of locations along said platen.

5. The apparatus of claim 4 wherein said sensors are proximity sensors for measuring said separation distance.

6. The apparatus of claim 4 wherein said platen is a fluid platen, in which fluid is dispensed within said region, and measurement of said separation distance determines thickness of said fluid along said platen.

7. The apparatus of claim 6 wherein said sensors are utilized to obtain measurements at said plurality of locations to adjust one or more fluid dispensing channels of said platen.

8. In a linear polisher for performing chemical-mechanical polishing (CMP) on a surface of a substrate or a layer formed on said substrate, and in which said surface is placed upon a linearly moving polishing pad for polishing said surface, an apparatus for determining a pressure being exerted on a region underlying said pad comprising:

a platen disposed along an underside of said pad opposite said surface;

plurality of sensors coupled to said platen to measure said pressure being exerted on said platen at plurality of locations along a surface of said platen.

9. The apparatus of claim 8 wherein said platen is a fluid platen in which fluid is dispensed between said platen and said pad or a belt upon which said pad is mounted; said platen also having openings formed along its surface in order for said fluid to flow therein; and said sensors coupled to said openings to measure pressure of said fluid in said openings.

10. The apparatus of claim 9 wherein said sensors are utilized to obtain pressure measurements at said plurality of locations along said surface and in which said pressure measurements are used to adjust one or more fluid dispensing channels of said platen.

11. The apparatus of claim 9 wherein said sensors are utilized to obtain pressure measurements at said plurality of locations along said surface to obtain an average pressure profile across said platen and said average pressure profile is used to adjust a downforce of a carrier carrying said substrate.

12. In a linear polisher for performing chemical-mechanical polishing (CMP) on a surface of a substrate or a layer formed on a substrate, and in which said surface is placed upon a linearly moving polishing pad for polishing said surface, a method of monitoring a separating distance of a region underlying said pad, comprising the steps of:

placing a platen along an underside of said pad or a belt upon which said pad is mounted opposite said surface and in which said region resides between said platen and said pad or said belt upon which said pad is mounted;

coupling plurality of sensors to said platen to measure said separating distance of said region at a plurality of locations along said platen.

13. The method of claim 12 wherein said step of placing said platen places a fluid platen in which fluid is dispensed between said platen and said pad or a belt upon which said pad is mounted; and measurement of said separating distance determines thickness of said fluid along said region.

14. The method of claim 13 further including the step of adjusting one or more fluid dispensing channels of said platen based on said measurements.

15. In a linear polisher for performing chemical-mechanical polishing (CMP) on a surface of a substrate or a layer formed on said substrate, and in which said surface is placed upon a linearly moving polishing pad for polishing said surface, a method of monitoring a pressure being exerted on a region underlying said pad, comprising the steps of:

placing a platen along an underside of said pad or a belt upon which said pad is mounted opposite said surface;

coupling plurality of sensors to said platen to measure said pressure being exerted on said platen at a plurality of locations along a surface of said platen.

16. The method of claim 15 wherein said step of placing said platen places a fluid platen in which fluid is dispensed between said platen and said pad or a belt upon which said pad is mounted; and measurement of said pressure measures fluid pressure at said plurality of locations.

17. The method of claim 16 wherein said step of placing said fluid platen includes placing said fluid platen with openings formed along its surface for passage of said fluid therein for coupling to pressure sensors to measure pressure of said fluid at said plurality of locations.

18. The method of claim 17 further including the step of adjusting one or more fluid dispensing channels of said platen based on said measurements.

19. The method of claim 17 further including the step of averaging said measurements to adjust a force exerted by said substrate onto said pad.

20. The method of claim 15 wherein said step of coupling said sensors couples strain gauges to said surface of said platen.

* * * * *

UNITED STATES PATENT AND TRADEMARK OFFICE

CERTIFICATE OF CORRECTION

PATENT NO. : 5,762,536

DATED : June 9, 1998

INVENTOR(S) : Anil K. Pant, et al

It is certified that error appears in the above-identified patent and that said Letters Patent is hereby corrected as shown below:

In the Drawings:

Drawing Sheet 2 of 3

Fig. 3

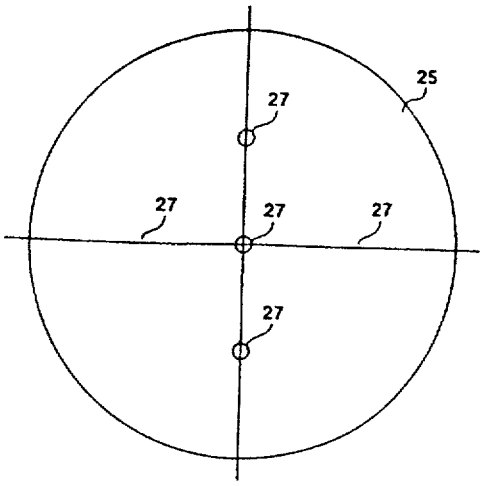

FIG. 3

UNITED STATES PATENT AND TRADEMARK OFFICE

CERTIFICATE OF CORRECTION

PATENT NO. : 5,762,536

DATED : June 9, 1998

INVENTOR(S) : Anil K. Pant, et al

It is certified that error appears in the above-identified patent and that said Letters Patent is hereby corrected as shown below:

Should be

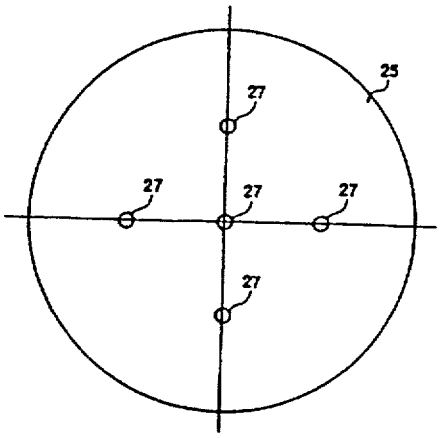

FIG. 3

UNITED STATES PATENT AND TRADEMARK OFFICE

CERTIFICATE OF CORRECTION

PATENT NO. : 5,762,536
DATED : June 9, 1998
INVENTOR(S) : Anil K. Pant, et al

It is certified that error appears in the above-identified patent and that said Letters Patent is hereby corrected as shown below:

Column 2, line 12
"process or" should be --process, or--
Column 2, line 19
"provides for" should be --provides--
Column 3, line 12
"a polishing" should be --the polishing--
Column 3, line 50-51
"known and prevalent" should be --known, and the prevalent--
Column 7, line 60
"know" should be --known--

Signed and Sealed this

Thirteenth Day of October 1998

*Attest:*

Bruce Lehman

BRUCE LEHMAN

*Attesting Officer*

*Commissioner of Patents and Trademarks*